US009051830B2

(12) United States Patent
Tips

(10) Patent No.: US 9,051,830 B2
(45) Date of Patent: Jun. 9, 2015

(54) TWO LINE OPERATION OF TWO HYDRAULICALLY CONTROLLED DOWNHOLE DEVICES

(71) Applicant: Halliburton Energy Services, Inc., Houston, TX (US)

(72) Inventor: Timothy R. Tips, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/313,509

(22) Filed: Jun. 24, 2014

(65) Prior Publication Data

US 2015/0053421 A1 Feb. 26, 2015

(30) Foreign Application Priority Data

Aug. 22, 2013 (WO) ..... PCT/US2013/056238

(51) Int. Cl.

| | |
|---|---|
| ***E21B 34/10*** | (2006.01) |
| ***E21B 43/25*** | (2006.01) |
| ***E21B 43/00*** | (2006.01) |

(52) U.S. Cl.

CPC ..... *E21B 43/25* (2013.01); *E21B 43/00* (2013.01); *E21B 34/10* (2013.01)

(58) Field of Classification Search

CPC ..... E21B 34/10
USPC ..... 166/374, 375, 319, 321, 386; 251/12, 251/20

See application file for complete search history.

(56) References Cited

U.S. PATENT DOCUMENTS

| | | | | |
|---|---|---|---|---|
| 6,247,536 | B1 | 6/2001 | Leismer et al. | |
| 6,516,888 | B1 * | 2/2003 | Gunnarson et al. | 166/373 |
| 6,575,237 | B2 | 6/2003 | Purkis et al. | |
| 6,585,051 | B2 | 7/2003 | Purkis et al. | |
| 6,595,296 | B1 * | 7/2003 | French | 166/375 |
| 7,182,139 | B2 * | 2/2007 | Rayssiguier et al. | 166/374 |
| 7,730,953 | B2 * | 6/2010 | Casciaro | 166/321 |
| 8,188,881 | B2 * | 5/2012 | Mandrou et al. | 340/853.3 |
| 8,602,112 | B2 * | 12/2013 | Reid | 166/375 |
| 2003/0048197 | A1 | 3/2003 | Purkis et al. | |
| 2007/0187106 | A1 * | 8/2007 | Wolters | 166/313 |
| 2010/0038093 | A1 * | 2/2010 | Patel | 166/375 |
| 2011/0079398 | A1 | 4/2011 | Patel et al. | |
| 2012/0168174 | A1 | 7/2012 | Vaghi et al. | |
| 2014/0054045 | A1 * | 2/2014 | Bell | 166/375 |

OTHER PUBLICATIONS

International Search Report and Written Opinion; PCT/US2013/056238; KIPO; May 22, 2014.

* cited by examiner

*Primary Examiner* — Kenneth L Thompson
(74) *Attorney, Agent, or Firm* — Haynes and Boone, LLP

(57) ABSTRACT

A downhole hydraulic control system includes a hydraulic control module positioned in a well. First and second hydraulically controlled devices are positioned in the well. The first hydraulically controlled device has a first actuator and the second hydraulically controlled device has a second actuator. First and second hydraulic control lines extend uphole of the hydraulic control module in the well. In a first configuration of the hydraulic control module, pressure variations in the first and second hydraulic control lines are operable to independently shift the first and second actuators in respective first directions. In a second configuration of the hydraulic control module, pressure variations in the first and second hydraulic control lines are operable to shift the first and second actuators in respective second directions.

10 Claims, 5 Drawing Sheets

TWO LINE OPERATION OF TWO HYDRAULICALLY CONTROLLED DOWNHOLE DEVICES

CROSS-REFERENCE TO RELATED APPLICATIONS

This application claims the benefit under 35 U.S.C. §119 of the filing date of International Application No. PCT/US2013/056238, filed Aug. 22, 2013.

TECHNICAL FIELD OF THE DISCLOSURE

This disclosure relates, in general, to equipment utilized in conjunction with operations performed in relation to subterranean wells and, in particular, to a downhole hydraulic control system utilizing a hydraulic control module and two hydraulic control lines to operate two hydraulically controlled downhole devices between multiple operating positions without the need for a J-slot mechanism.

BACKGROUND

Without limiting the scope of the present disclosure, its background is described with reference to downhole hydraulic control systems operating in a wellbore that traverses a hydrocarbon bearing subterranean formation, as an example.

It is well known in the subterranean well production art that production of hydrocarbon fluids can be improved by installing well monitoring equipment and completion components that can be adjusted during the life of the well. For example, certain well installations may include some combination of zonal isolation devices, interval control devices, downhole control systems, permanent monitoring systems, surface control and monitoring systems, distributed temperature sensing systems, data acquisition and management software and system accessories.

Once production begins, data from the well monitoring equipment can be used, for example, to regulate downhole flow control devices to control production from the various zones. Using a plurality of flow control devices allows an operator to selectively receive or restrict production from the different zones by opening, closing or choking flow through specific flow control devices. Typically, the actuation of such flow control devices may be accomplished with a hydraulic control system. In one implementation, each flow control device has two control lines associated therewith, one acting on either side of the actuation piston to open, close and potentially choke the flow control device. In this implementation, if there is two flow control devices in the completion, four control lines are required. In a more recent implementation, a common control line is associated with one port of each of the flow control devices with individual controls lines being run to the other port of each of the flow control devices. This implementation is known as an N+1 control system wherein N is the number individual control lines that run to the flow control devices and the plus 1 refers to the common control line. In this implementation, if there is two flow control devices in the completion, three control lines are required.

Regardless of the exact hydraulic control system implementation, it has been found that there is often a limitation on the number of control line penetrations that can be made, for example, at the wellhead, the tubing hanger, the production packer or through other well equipment. As such, the number of flow control devices and other hydraulically controlled devices in a completion is limited to no more than half the number of control line penetrations in a two control line implementation. Similarly, the number of flow control devices and other hydraulically controlled devices in a completion is limited to no more than one less than the number of control line penetrations in an N+1 implementation.

A need has therefore arisen for an improved downhole hydraulic control system for actuating hydraulically controlled devices positioned in a well that does not require a greater number of control lines than the number of hydraulically controlled devices.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
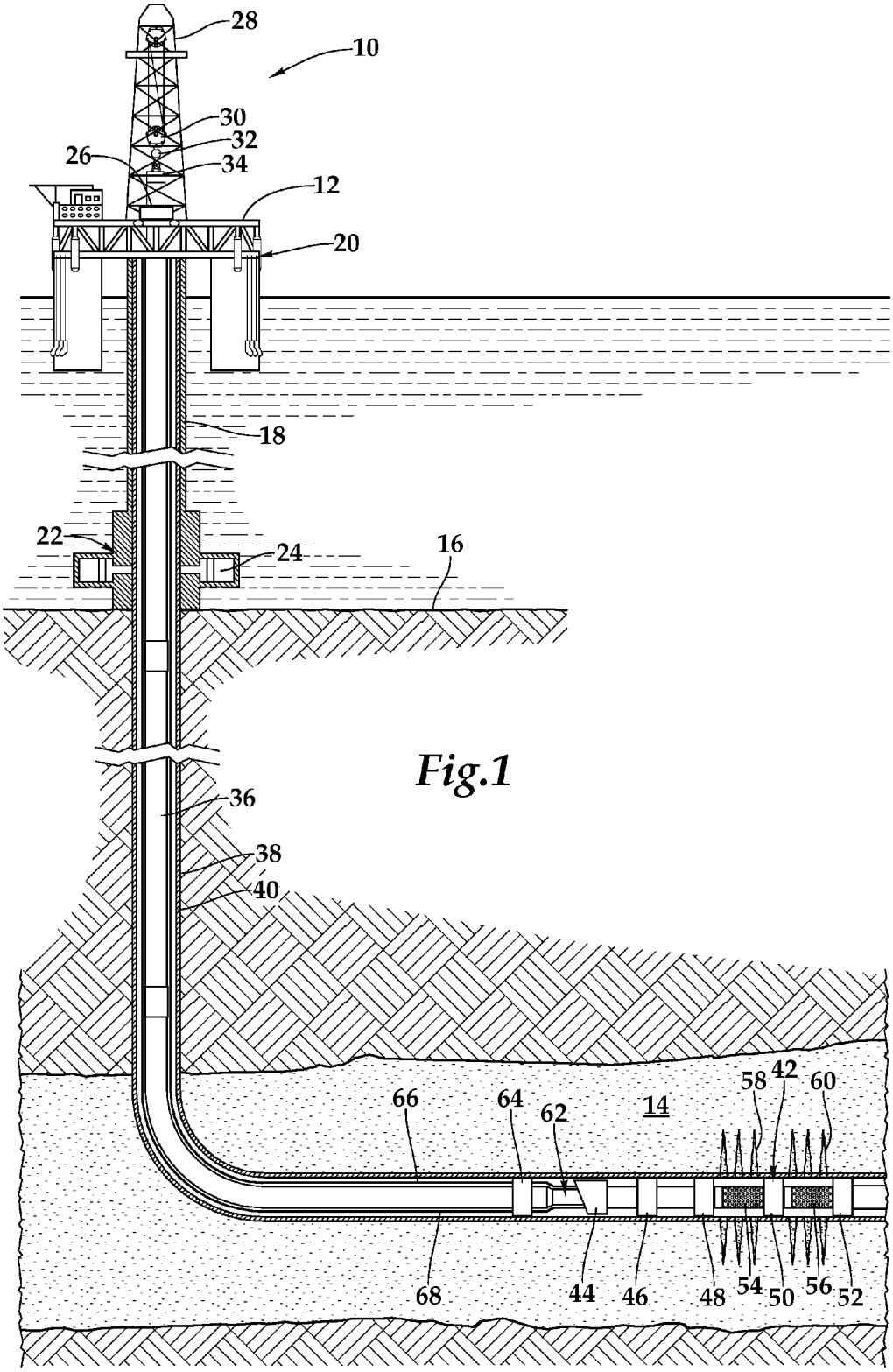
FIG. 1 is a schematic illustration of an offshore platform installing a completion including a downhole hydraulic control system according to an embodiment of the present disclosure.

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

The present disclosure is directed to a downhole hydraulic control system and method that utilize a hydraulic control module and two hydraulic control lines to operate two hydraulically controlled downhole devices between multiple operating positions without the need for a J-slot mechanism. It should be understood by those skilled in the art that the system and method taught in the present disclosure are scalable and may be implemented in well systems requiring control over a greater number of hydraulically controlled downhole devices.

In a first aspect, the present disclosure is directed to a downhole hydraulic control system. The system includes a hydraulic control module positioned in a well. First and second hydraulically controlled devices are positioned in the well. The first hydraulically controlled device has a first actuator and the second hydraulically controlled device has a second actuator. First and second hydraulic control lines extend uphole of the hydraulic control module in the well. In a first configuration of the hydraulic control module, pressure variations in the first and second hydraulic control lines are operable to independently shift the first and second actuators in respective first directions. In a second configuration of the hydraulic control module, pressure variations in the first and second hydraulic control lines are operable to shift the first and second actuators in respective second directions.

In certain embodiments, the first and second hydraulically controlled devices may be fluid flow control devices. In these embodiments, independently shifting the first and second actuators in respective first directions may result in independently opening the first and second fluid flow control devices; independently shifting the first and second actuators in respective first directions may result in independently incrementing the first and second fluid flow control devices toward fully open positions and/or shifting the first and second actuators in respective second directions may result in closing the first and second fluid flow control devices. In one embodiment, the hydraulic control module may be operated from the first configuration to the second configuration responsive to pressure variations in the first and second hydraulic control lines. For example, a high pressure signal in the second hydraulic control line may be operable to unlock a release assembly followed by a high pressure signal in the first hydraulic control line that may be operable shift a piston from a first position to a second position, thereby operating the hydraulic control module from the first configuration to the second configuration.

In one embodiment, the first actuator may be operated in the first direction of the first actuator responsive to a high pressure signal in the first hydraulic control line ported through the hydraulic control module to a first side of the first actuator and a low pressure signal in the second hydraulic control line ported to a second side of the first actuator. In some embodiments, the second actuator may be operated in the first direction of the second actuator responsive to a high pressure signal in the second hydraulic control line ported to a first side of the second actuator and a low pressure signal in the first hydraulic control line ported through the hydraulic control module to a second side of the second actuator. In certain embodiments, the first and second actuators may be operated in respective second directions responsive to a high pressure signal in the first hydraulic control line ported through the hydraulic control module to the second sides of the first and second actuators, a low pressure signal in the second hydraulic control line ported through the hydraulic control module to the first side the first actuator and a low pressure signal in the second hydraulic control line ported to the first side the second actuator.

In a second aspect, the present disclosure is directed to a downhole control method. The method includes positioning a downhole hydraulic control system in a well, the system including a hydraulic control module, first and second hydraulically controlled devices, the first hydraulically controlled device having a first actuator, the second hydraulically controlled device having a second actuator and first and second hydraulic control lines extending uphole of the hydraulic control module; independently shifting the first and second actuators in respective first directions responsive to pressure variations in the first and second hydraulic control lines when the hydraulic control module is in a first configuration; and shifting the first and second actuators in respective second directions responsive to pressure variations in the first and second hydraulic control lines when the hydraulic control module is in a second configuration.

The method may also include operating first and second fluid flow control devices; independently opening the first and second fluid flow control devices; independently incrementing the first and second fluid flow control devices toward fully open positions; closing the first and second fluid flow control devices; operating the hydraulic control module from the first configuration to the second configuration responsive to pressure variations in the first and second hydraulic control lines; unlocking a release assembly of the hydraulic control module responsive to a high pressure signal in the second hydraulic control line; shifting a piston of the hydraulic control module from a first position to a second position responsive to a high pressure signal in the first hydraulic control line; shifting the first actuator in the first direction of the first actuator responsive to a high pressure signal in the first hydraulic control line ported through the hydraulic control module to a first side of the first actuator and a low pressure signal in the second hydraulic control line ported to a second side of the first actuator; shifting the second actuator in the first direction of the second actuator responsive to a high pressure signal in the second hydraulic control line ported to a first side of the second actuator and a low pressure signal in the first hydraulic control line ported through the hydraulic control module to a second side of the second actuator; and/or shifting the first and second actuators in respective second directions responsive to a high pressure signal in the first hydraulic control line ported through the hydraulic control module to the second sides of the first and second actuators, a low pressure signal in the second hydraulic control line ported through the hydraulic control module to the first side the first actuator and a low pressure signal in the second hydraulic control line ported to the first side the second actuator.

In a third aspect, the present disclosure is directed to a hydraulic control module for use in a downhole hydraulic control system having first and second hydraulic control lines for operating first and second hydraulically controlled devices having first and second actuators, respectively. The hydraulic control module includes a housing having a plurality of first ports in fluid communication with the first hydraulic control line, a plurality of second ports in fluid communication with the second hydraulic control line, a third port and a fourth port. A release assembly is disposed within the housing. A piston is slidably disposed within the housing. The piston has a first position relative to the housing in which at least one of the first ports is in fluid communication with the third port. The piston has a second position relative to the housing in which at least one of the first ports is in fluid communication with the fourth port and at least one of the second ports is in fluid communication with the third port. The piston is selectively retained in the first position by the release assembly. The release assembly is unlocked responsive to a high pressure signal in the second hydraulic control line and, while the release assembly is unlocked, the piston is shifted from the first position to the second position responsive to a high pressure signal in the first hydraulic control line.

In one embodiment, the release assembly may include a sleeve and a collet assembly. In this embodiment, the sleeve may selectively prop the collet assembly to retain the piston in the first position. Also, in this embodiment, the sleeve may be slidably disposed within the housing between locked and unlocked positions. The sleeve may be biased toward the locked position by a spring and biases toward the unlocked position by the high pressure signal in the second hydraulic control line. In some embodiments, the sleeve may have a timing delay element operable to control the velocity at which the sleeve travels from the unlocked positioned toward the locked position to provide a time window for the high pressure signal in the first hydraulic control line to shift the piston from the first position to the second position after release of the high pressure signal in the second hydraulic control line. In certain embodiments, a spring biases the piston from the second position toward the first position.

In an embodiment, when the piston is in the first position, a high pressure signal in the first hydraulic control line is ported through the hydraulic control module to a first side of the first actuator and a low pressure signal in the second hydraulic control line is ported to a second side of the first actuator to operate the first actuator in a first direction. Also, when the piston is in the first position, a high pressure signal in the second hydraulic control line is ported to a first side of the second actuator and a low pressure signal in the first hydraulic control line is ported through the hydraulic control module to a second side of the second actuator to operate the second actuator in a first direction. When the piston is in the second position, a high pressure signal in the first hydraulic control line is ported through the hydraulic control module to the second sides of the first and second actuators, a low pressure signal in the second hydraulic control line is ported through the hydraulic control module to the first side the first actuator and the low pressure signal in the second hydraulic control line ported to the first side of the second actuator to operate the first and second actuators in respective second directions.

In a fourth aspect, the present disclosure is directed to a downhole hydraulic control system. The system includes a hydraulic control module positioned in the well. First and second flow control devices are positioned in the well. First and second hydraulic control lines are positioned in the well. The first flow control device is incremented toward a fully open position responsive to a high pressure signal in the first hydraulic control line ported through the hydraulic control module to a first side of an actuator of the first flow control device and a low pressure signal in the second hydraulic control line ported to a second side of the actuator of the first flow control device. The second flow control device is incremented toward a fully open position responsive to a high pressure signal in the second hydraulic control line ported to a first side of an actuator of the second flow control device and a low pressure signal in the first hydraulic control line ported through the hydraulic control module to a second side of the actuator of the second flow control device. The first and second flow control devices are closed responsive to a high pressure signal in the first hydraulic control line ported through the hydraulic control module to the second sides of the actuators of the first and second flow control devices, a low pressure signal in the second hydraulic control line ported through the hydraulic control module to the first side of the actuator of the first flow control device and the low pressure signal in the second hydraulic control line ported to the first side of the actuator of the second flow control device.

In a fifth aspect, the present disclosure is directed to a downhole control method. The method includes positioning a downhole hydraulic control system in the well, the system including a hydraulic control module, first and second flow control devices and first and second hydraulic control lines; incrementing the first flow control device toward a fully open position responsive to a high pressure signal in the first hydraulic control line ported through the hydraulic control module to a first side of an actuator of the first flow control device and a low pressure signal in the second hydraulic control line ported to a second side of the actuator of the first flow control device; incrementing the second flow control device toward a fully open position responsive to a high pressure in the second hydraulic control line ported to a first side of an actuator of the second flow control device and a low pressure signal in the first hydraulic control line ported through the hydraulic control module to a second side of the actuator of the second flow control device; and closing the first and second flow control devices responsive to a high pressure signal in the first hydraulic control line ported through the hydraulic control module to the second sides of the actuators of the first and second flow control devices, a low pressure signal in the second hydraulic control line ported through the hydraulic control module to the first side the actuator of the first flow control device and the low pressure signal in the second hydraulic control line ported to the first side of the actuator of the second flow control device.

Referring initially to FIG. 1, an upper completion assembly having a downhole hydraulic control system is being installed in a well from an offshore oil or gas platform that is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a substantially tubular, axially extending tubular string 36.

A wellbore 38 extends through the various earth strata including formation 14 and has a casing string 40 cemented therein. Disposed in a substantially horizontal portion of wellbore 38 is a lower completion assembly 42 that includes various tools such as alignment subassembly 44, packers 46, 48, 50, 52 and sand control screen assemblies 54, 56. Packers 48, 50, 52 divide the completion interval into two zones; namely, zones 58, 60. Being installed within lower completion assembly 42 is an upper completion assembly 62 that includes various tools such as packer 64, a hydraulic control module (not visible) and two flow control devices (not visible) such as interval control valves with incremental control modules offered by Halliburton WellDynamics as components in an intelligent completion. Each of the flow control devices is used to independently regulate production from one of the zones 58, 60. Two hydraulic control lines 66, 68 extend from the surface and are ported to the hydraulic control module as well as the two flow control devices.

Even though FIG. 1 depicts a horizontal wellbore, it should be understood by those skilled in the art that the present downhole hydraulic control system is equally well suited for use in wellbores having other orientations including vertical wellbores, slanted wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the present downhole hydraulic control system is equally well suited for use in onshore operations. Further, even though FIG. 1 depicts a cased hole completion, it should be understood by those skilled in the art that the present downhole hydraulic control system is equally well suited for use in open hole completions.

Figure 2A:
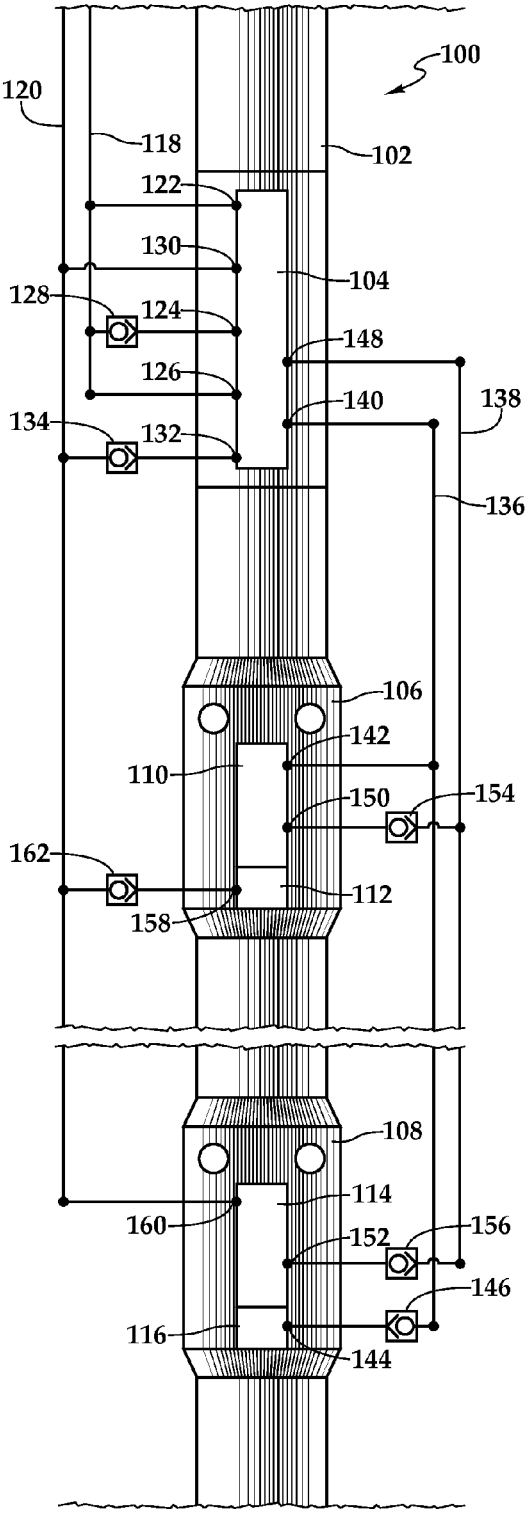
FIGS. 2A-2F are a schematic illustration of a well system including a downhole hydraulic control system according to an embodiment of the present disclosure.
Figure 2B:
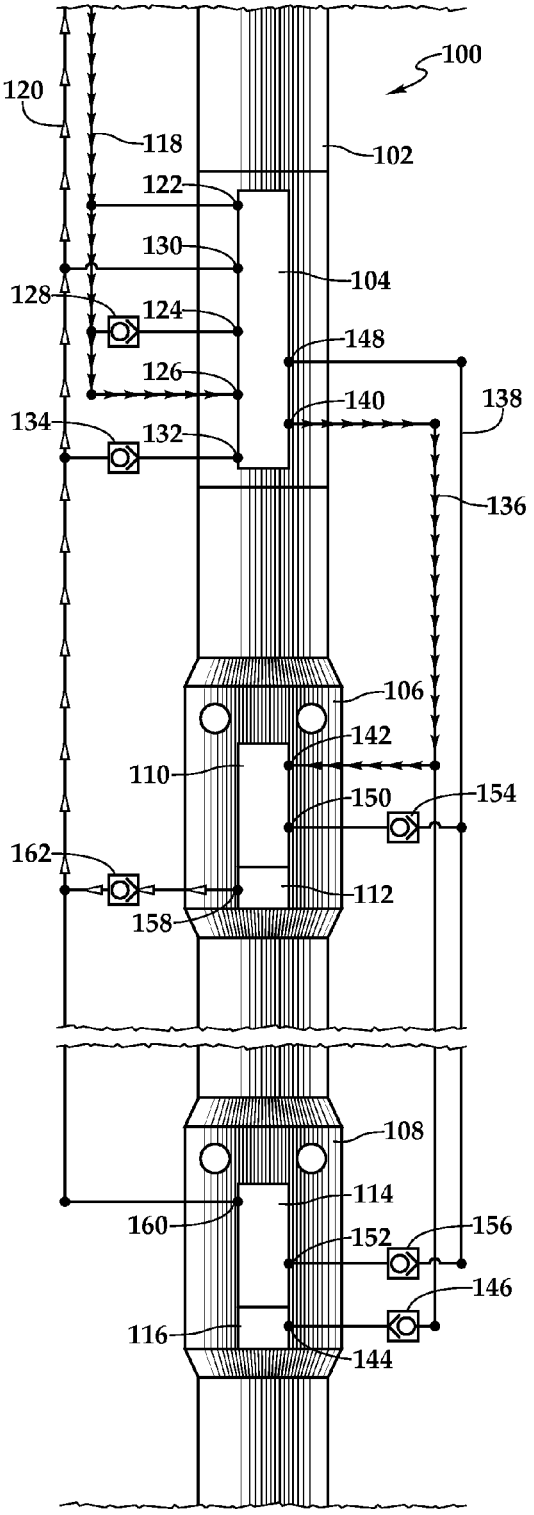

Referring next to FIG. 2A, therein is depicted a downhole hydraulic control system that may be part of the upper completions assembly described above that is schematically illustrated and generally designated 100. Downhole hydraulic control system 100 is interconnected in a tubing string 102 that may be at least partially disposed in a lower completion as described above. In the illustrated embodiment, system 100 includes a hydraulic control module 104, a first hydraulically controlled device depicted as a flow control device or an interval control valve 106 and a second hydraulically controlled device depicted as a flow control device or an interval control valve 108. Preferably, flow control device 106 is operably associated with one interval of the well, such as zone 58 and flow control device 108 is operably associated with another interval of the well, such as zone 60. In this configuration, flow control devices 106, 108 are operable to provide zonal control to enable effective management of individual zone productivity. As illustrated, flow control device 106 has a hydraulically controlled actuator 110 that is operably associated with an incremental control module 112. Likewise, flow control device 108 has a hydraulically controlled actuator 114 that is operably associated with an incremental control module 116.

Incremental control modules 112, 116 are preferably hydraulically operated fluid metering devices that discharge of a known volume of fluid to enable precise control over displacement of pistons in the associated hydraulically controlled actuators 110, 114. In the illustrated embodiment, incremental control modules 112, 116 are fluidically coupled to the closing sides of hydraulically controlled actuators 110, 114. For example, in this configuration, pressurizing the opening side of actuator 110 results in the discharge of the known volume of fluid from the closing side of actuator 110 into incremental control module 112, which allows the piston of actuator 110 to be displaced a known distance, thereby producing a known increment of flow control device 106 toward the fully open position. The process of discharging the known volume of fluid into incremental flow control device 106 may be repeated to produce the desired total degree of actuation of the piston of actuator 110. Actuator 114 and incremental control module 116 operate in the same manner. The closing operation of flow control devices 106, 108 is generally unaffected by incremental control modules 112, 116 as pressurization of the closing sides of actuators 110, 114 does not involve incrementing and instead occurs responsive to a single pressure signal. Even though FIG. 2A depicts an incremental control module associated with each actuator, it should be understood by those skilled in the art that the present downhole hydraulic control system does not require the use of incremental control modules in association with the hydraulically controlled devices. Also, even though FIG. 2A depicts the incremental control modules as being integral with the actuators on the closing side, it should be understood by those skilled in the art that the incremental control modules could be positioned in other locations in the downhole hydraulic control system including being integral with the actuators on the opening side or remote from the actuators on either the closing side or the opening side.

System 100 includes two hydraulic control lines 118, 120 that extend uphole from hydraulic control module 104. As described above, there is often a limitation on the number of control line penetrations that can be made, for example, at the wellhead, the tubing hanger, the production packer or through other well equipment. In the conventional N+1 control methodology, for N hydraulically controlled devices there is a requirement for N+1 control lines. One dedicate control line is ported to each of the hydraulically controlled devices and an addition common control line is port to each of the hydraulically controlled devices. In the presently described completion, for example, operation of flow control devices 106, 108 in an N+1 control system would require three control lines. In the present downhole hydraulic control system 100, however, only two control lines are available; namely, hydraulic control lines 118, 120. Using various configurations of hydraulic control module 104, pressure variations in hydraulic control lines 118, 120 are operable to independently shift actuators 110, 114 in respective first directions, in this case incrementally toward their fully open positions, and pressure variations in hydraulic control lines 118, 120 are operable to shift actuators 110, 114 in respective second directions, in this case to their closed positions.

In the illustrated embodiment, hydraulic control line 118 is in fluid communication with ports 122, 124, 126 of hydraulic control module 104. Fluid communication between hydraulic control line 118 and port 124 is limited to one way communication from port 124 to hydraulic control line 118 by a check valve 128. Ports 122, 124, 126 may be referred to collectively as first ports. Alternatively, hydraulic control line 118 could be in fluid communication with other numbers of ports including a single port of hydraulic control module 104 with an internal manifold or other fluid distribution system routing fluid as required therein. In the illustrated embodiment, hydraulic control line 120 is in fluid communication with ports 130, 132 of hydraulic control module 104. Fluid communication between hydraulic control line 120 and port 132 is limited to one way communication from port 132 to hydraulic control line 118 by a check valve 134. Ports 130, 132 may be referred to collectively as second ports. Alternatively, hydraulic control line 120 could be in fluid communication with other numbers of ports including a single port of hydraulic control module 104 with an internal manifold or other fluid distribution system routing fluid as required therein.

Extending downhole of hydraulic control module 104 may be any desired number of hydraulic control lines as there is no limitation on downhole extending control lines. In the illustrated embodiment, hydraulic control lines 136, 138 extend downhole from hydraulic control module 104 and a lower portion of hydraulic control line 120 also extends downhole of hydraulic control module 104. Hydraulic control line 136 is in fluid communication with port 140 of hydraulic control module 104, which may be referred to as a third port. Hydraulic control line 136 is also in fluid communication with port 142 on the opening side of actuator 110 and port 144 on the closing side of actuator 114 and more specifically on incremental control module 116. Fluid communication between hydraulic control line 136 and port 144 is limited to one way communication from port 144 to hydraulic control line 136 by a check valve 146. Hydraulic control line 138 is in fluid communication with port 148 of hydraulic control module 104, which may be referred to as a fourth port. Hydraulic control line 138 is also in fluid communication with port 150 on the closing side of actuator 110 and port 152 on the closing side of actuator 114. Fluid communication between hydraulic control line 138 and port 150 is limited to one way communication from hydraulic control line 138 to port 150 by a check valve 154. Fluid communication between hydraulic control line 138 and port 152 is limited to one way communication from hydraulic control line 138 to port 152 by a check valve 156. Hydraulic control line 120 is in fluid communication with port 158 on the closing side of actuator 110 and more specifically on incremental control module 112. Hydraulic control line 120 is also in fluid communication with port 160 on the opening side of actuator 114. Fluid communication between hydraulic control line 120 and port 158 is limited to one way communication from port 158 to hydraulic control line 120 by a check valve 162.

Figure 3A:
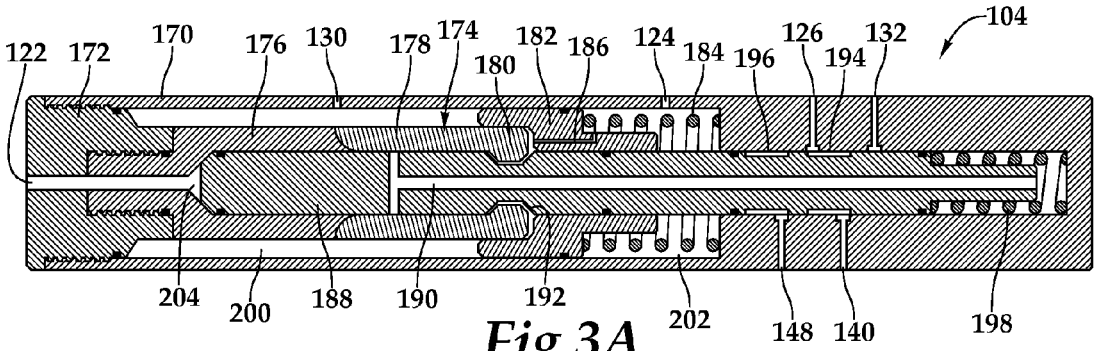
FIGS. 3A-3D are cross sectional views of a hydraulic control module in various operating configurations for use in a downhole hydraulic control system according to an embodiment of the present disclosure.

Referring additionally to FIG. 3A, therein is depicted a cross sectional view of hydraulic control module 104. Hydraulic control module 104 includes a housing 170 with an end cap 172 threadably received on one end thereof. As previously described, hydraulic control module 104 includes first ports 122, 124, 126, second ports 130, 132, third port 140 and fourth port 148. A release assembly 174 is disposed within housing 170. In the illustrated embodiment, release assembly 174 includes a collet assembly 176 that is threadably coupled to end cap 172. Collet assembly 176 has a plurality of radially extendable collet fingers 178 each having an inwardly radially extending head 180. Release assembly 174 also includes a sleeve 182 that is slidably disposed within housing 170. Sleeve 182 has a locking position wherein sleeve 182 props collet fingers 178 preventing outward radial movement of collet fingers 178, as best seen in FIG. 3A, and an unlocked position wherein sleeve 182 does not prevents outward radial movement of collet fingers 178, as best seen in FIG. 3D. Sleeve 182 is biased toward the locked position by a spring 184. Sleeve 182 includes a timing delay element depicted as fluid passageway 186 that is operable to control the velocity at which sleeve 182 travels from the unlocked positioned toward the locked position, the benefit of which is discussed below.

A piston 188 is slidably and sealingly disposed within housing 170, collet assembly 176 and sleeve 182. Preferably, piston 188 includes an internal fluid passage 190 to enable ease of movement of piston 188 through fluid within hydraulic control module 104. Piston 188 has a radially reduced channel 192 operable to receive collet heads 180. In addition, piston 188 has a pair of radially reduced cylindrical fluid pathways 194, 196. Piston 188 has a first position relative to housing 170, as best seen in FIG. 3A and second position relative to housing 170, as best seen in FIG. 3D. A spring 198 biases piston 188 from the second position toward the first position. A fluid chamber 200 is defined between housing 170, end cap 172 and sleeve 182. Fluid chamber 200 is in fluid communication with port 130. A fluid chamber 202 is defined between housing 170, piston 188 and sleeve 182. Fluid chamber 202 is in fluid communication with port 124. A fluid chamber 204 is defined between piston 188 and collet assembly 176. Fluid chamber 204 is in fluid communication with port 122.

The operation of downhole hydraulic control system 100 will now be described with references to FIGS. 2A-2F and 3A-3D. Downhole hydraulic control system 100 enables the operation of two hydraulically controlled downhole devices between multiple operating positions with only two hydraulic control lines and without the need for a J-slot mechanisms in the hydraulically controlled downhole devices. In addition, downhole hydraulic control system 100 enables independent operation of each of the hydraulically controlled downhole devices in some configurations and simultaneous operation of the two hydraulically controlled downhole devices in other configurations. For example, in the case of fluid control valves, downhole hydraulic control system 100 enables independent operation of each of the fluid control valves in the open direction such as by individually incrementing each of the fluid control valves to its desired setting while also allowing for simultaneous closing of both fluid control valves when desired. Downhole hydraulic control system 100 also enables closing of the fluid control valves regardless of their current position without the requirement of cycle the fluid control valves through additional incremental open positions as would be required in a J-slot implementation. This feature also allows for more efficient resetting of the fluid control valves to a less open or greater choking position as the fluid control valves can be returned to known configurations, in this case their fully closed positions, in a single operation then individually incremented from the fully closed positions to the desired positions.

Figure 3B:
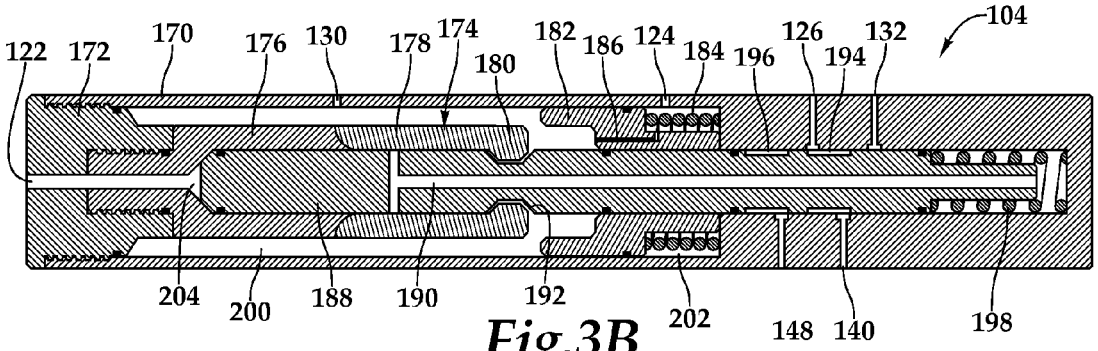

In a first configuration of hydraulic control module 104 wherein piston 188 is in its first position such that port 126 is in fluid communication with port 140 via cylindrical fluid pathways 194, as best seen in FIG. 3A-3B, downhole hydraulic control system 100 is operable to individually increment actuator 110 of valve 106 and actuator 114 of valve 108. Specifically, responsive to a high pressure signal in control line 118 and a low pressure signal in control line 120, high pressure is ported to the opening side of actuator 110 through ports 126, 140, 142 as depicted by the dense solid arrows in FIG. 2B and low pressure is ported to the closing side of actuator 110 through port 158 as depicted by the sparse hollow arrows in FIG. 2B. In the illustrated embodiment, this high/low signal increments actuator 110 one position due to the operation of incremental control module 112. Release of and then repeating this high/low signal will cause actuator 110 to progress toward its fully open position incrementally. The high/low signal does not cause any operation of actuator 114. During this operation, hydraulic control module 104 remains in the position depicted in FIG. 3A.

Figure 2C:
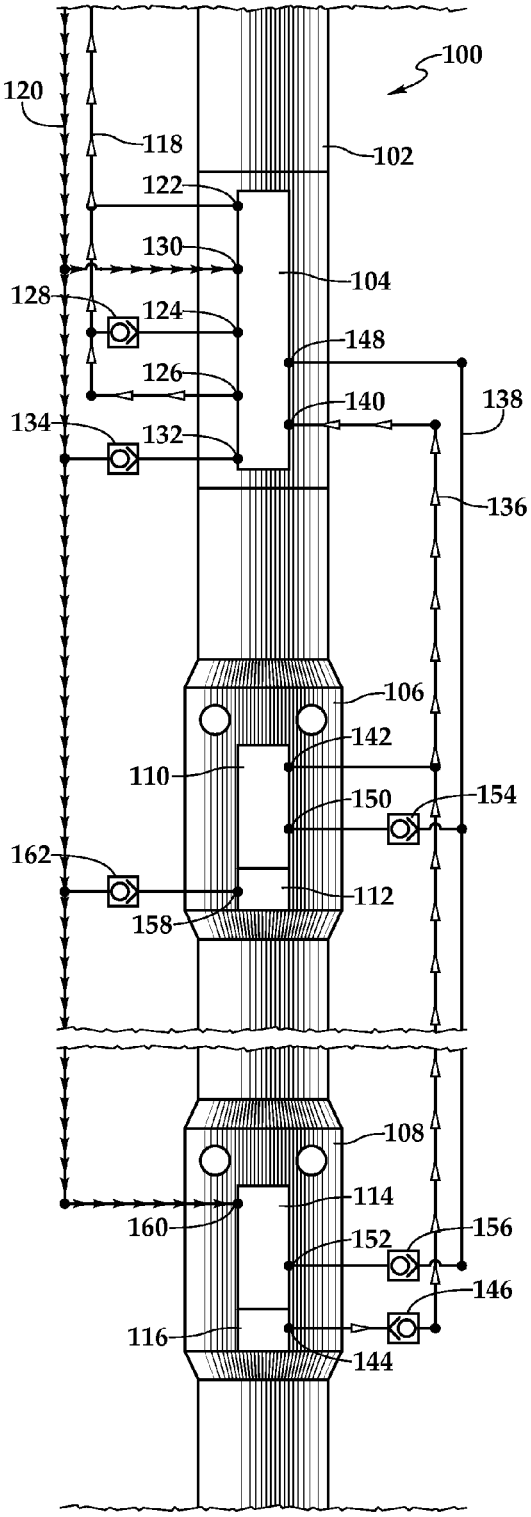
Figure 2D:
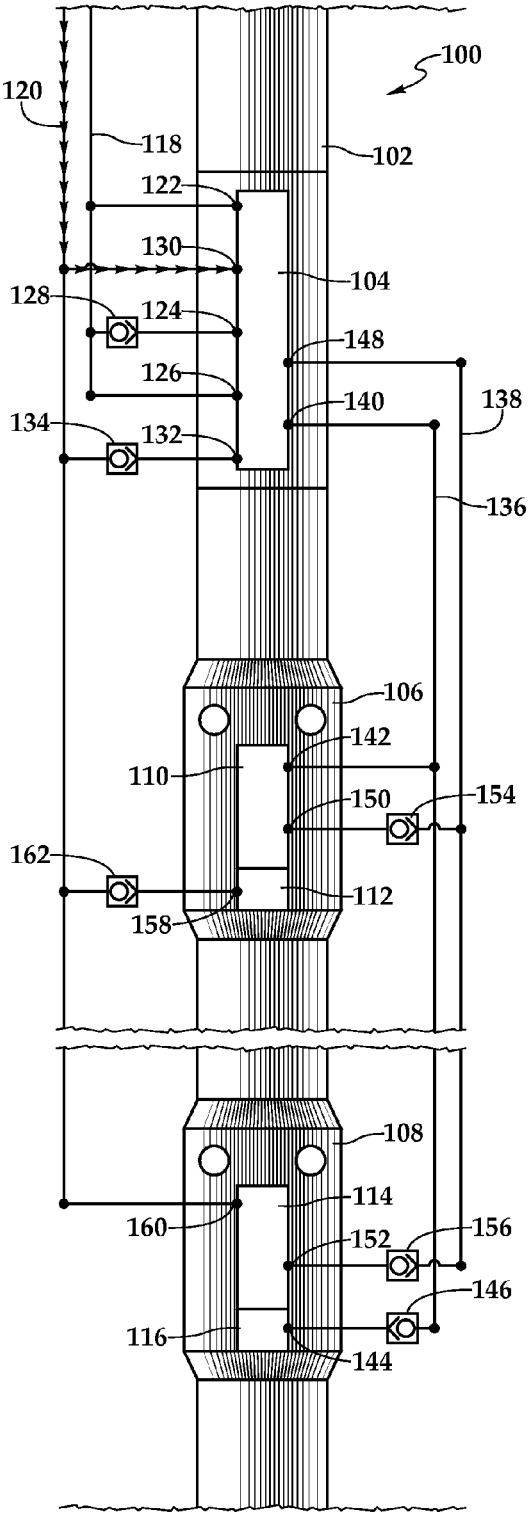
Figure 2E:
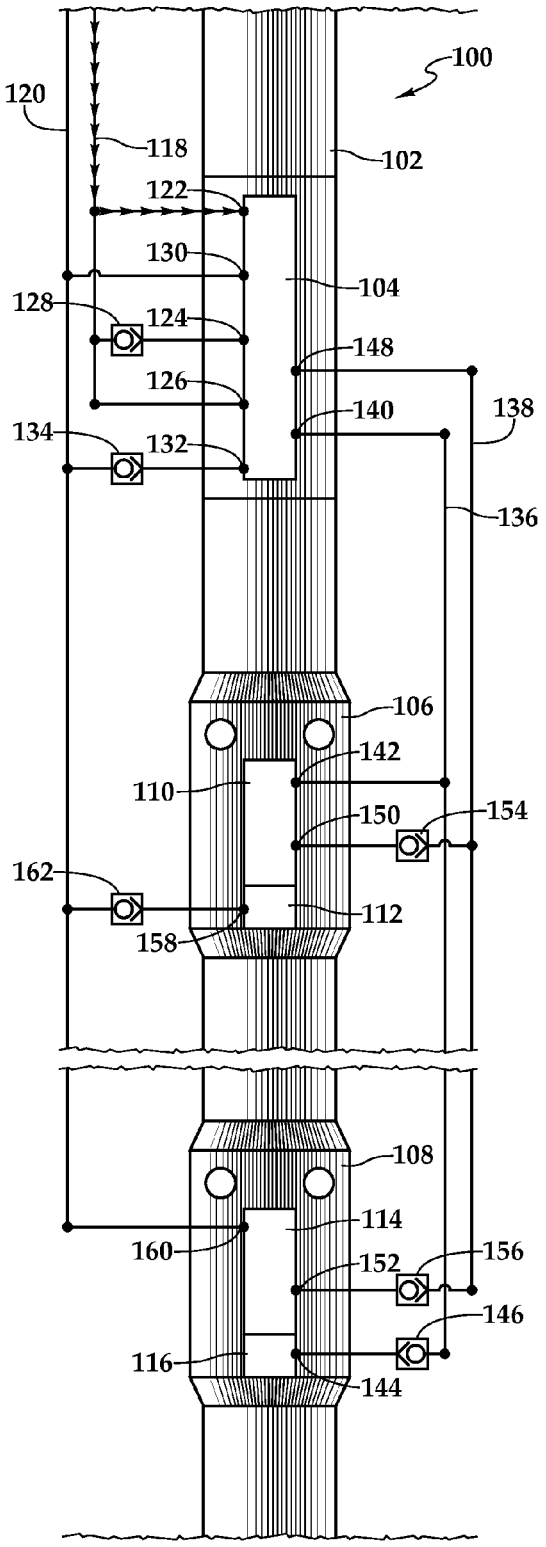
Figure 2F:
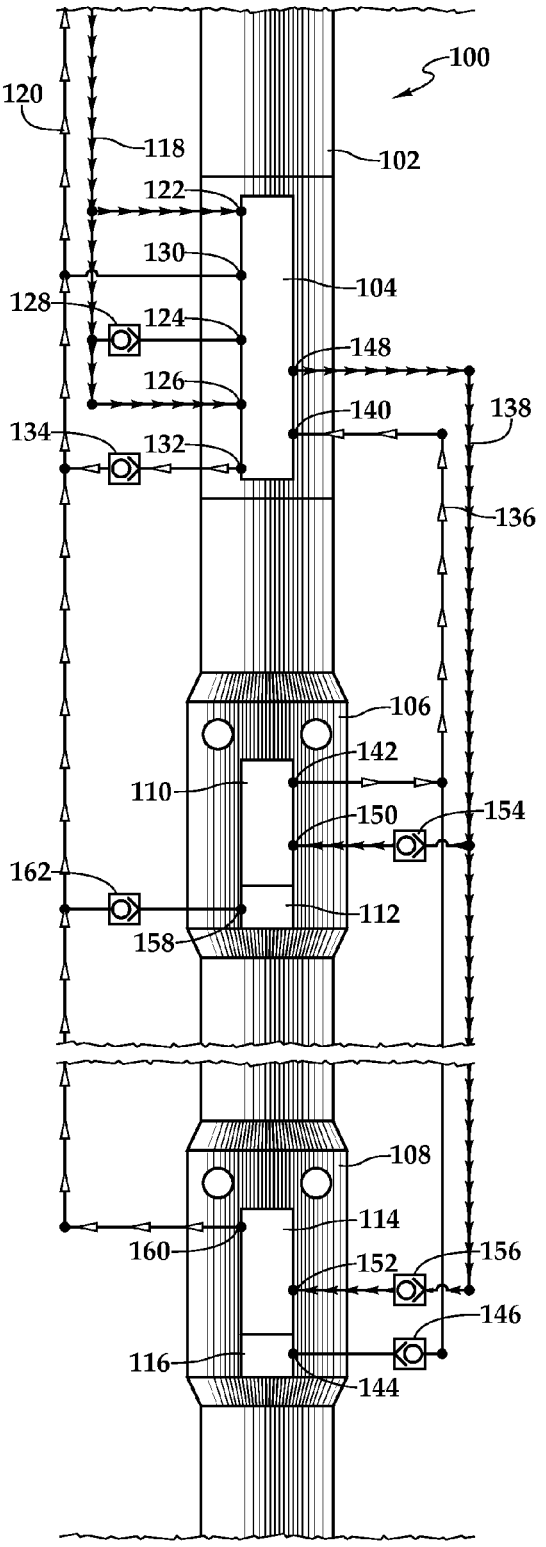

Similarly, responsive to a low pressure signal in control line 118 and a high pressure signal in control line 120, high pressure is ported to the opening side of actuator 114 through port 160 as depicted by the dense solid arrows in FIG. 2C and low pressure is ported to the closing side of actuator 114 through ports 126, 140, 144 as depicted by the sparse hollow arrows in FIG. 2C. In the illustrated embodiment, this low/high signal increments actuator 114 one position due to the operation of incremental control module 116. Release of and then repeating this low/high signal will cause actuator 114 to progress toward its fully open position incrementally. The low/high signal does not cause any operation of actuator 110. During this operation, hydraulic control module 104 may operate between the positions depicted in FIG. 3A and FIG. 3B as the high pressure signal of control line 120 is also received at port 130, which pressurizes chamber 200 shifting sleeve 182 from the locked position to the unlocked position. Even in this unlocked configuration of release assembly 174, however, piston 188 remains in the first position as the low pressure signal in control line 118 via port 122 does not create a sufficient force acting of piston 188 to overcome the combination of the spring force of collet assembly 176 and the spring force of spring 198.

Figure 3C:
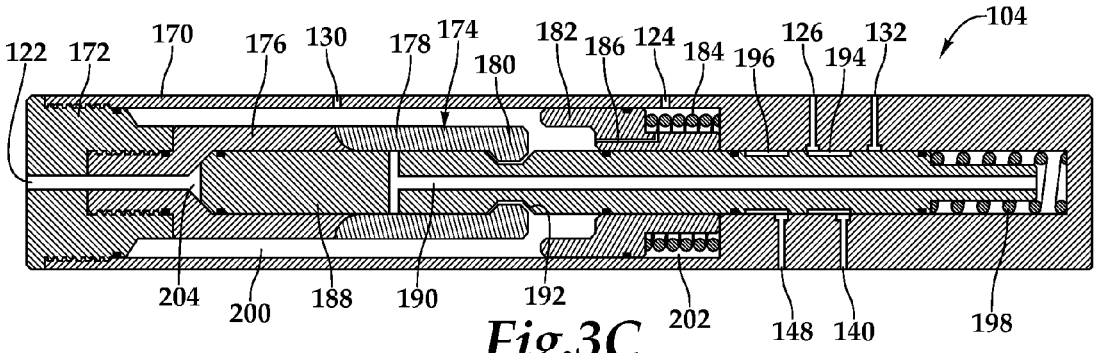
Figure 3D:
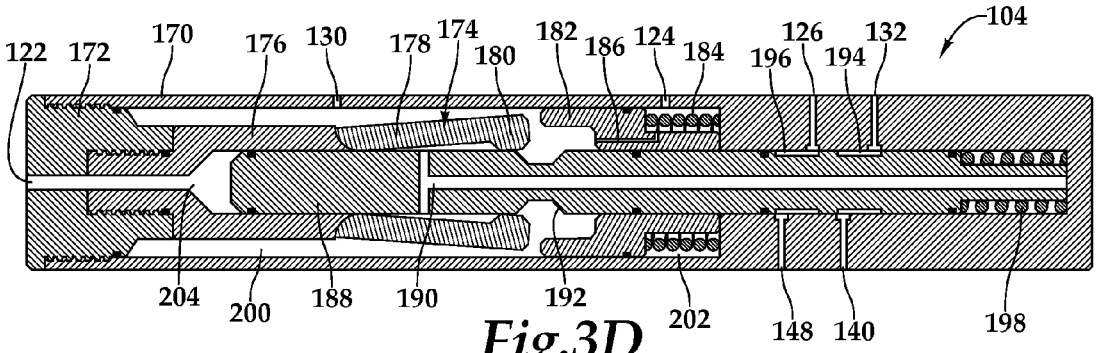

In a second configuration of hydraulic control module 104 wherein piston 188 is in its second position such that port 126 is in fluid communication with port 148 via cylindrical fluid pathways 196 and port 132 is in fluid communication with port 140 via cylindrical fluid pathways 194, as best seen in FIG. 3D, downhole hydraulic control system 100 is operable to close actuator 110 of valve 106 and actuator 114 of valve 108. Hydraulic control module 104 is operated from the first configuration to the second configuration responsive to a high pressure signal in control line 120 followed by a high pressure signal in control line 118. The high pressure signal in control line 120 is ported to port 130 of hydraulic control module 104 as depicted by the dense solid arrows in FIG. 2D. The high pressure pressurizes chamber 200 shifting sleeve 182 from the locked position to the unlocked position, as best seen in FIG. 3C. Once hydraulic control module 104 is in the position depicted in FIG. 3C, the high pressure signal in control line 120 may be maintained or released as sleeve 182 includes timing delay element 186 that causes sleeve 182 to travel slowly from the unlocked positioned toward the locked position providing a sufficient time window for the subsequent high pressure signal in control line 118 to reach hydraulic control module 104 even after release of the high pressure signal in control line 120. Thus, prior to sleeve 182 returning to the locked position, the high pressure signal in control line 118 is ported to port 122 of hydraulic control module 104 as depicted by the dense solid arrows in FIG. 2E. The high pressure pressurizes chamber 204 via port 122 shifting piston 188 from the first position to the second position by overcoming the combination of the spring force of collet assembly 176 and the spring force of spring 198, as best seen in FIG. 3D. Once hydraulic control module 104 is in the position depicted in FIG. 3D, as long as the high pressure signal in control line 118 may be maintained, piston 188 remains in the second position.

Now, responsive to a high pressure signal in control line 118 and a low pressure signal in control line 120, valves 106, 108 are closed. Specifically, high pressure is ported to the closing side of actuator 110 through ports 126, 148, 150, high pressure is ported to the closing side of actuator 114 through ports 126, 148, 152 as depicted by the dense solid arrows in FIG. 2F, low pressure is ported to the opening side of actuator 110 through ports 132, 140, 142 and low pressure is ported to the opening side of actuator 114 through port 160 as depicted by the sparse hollow arrows in FIG. 2F. In the illustrated embodiment, this high/low signal closes valves 106, 108 in a single operation without incrementing actuators 110, 114. Releasing the high pressure signal on control line 118 allows piston 188 to return to its first position responsive to the bias force of spring 198. Thereafter, release assembly 174 engages piston 188, which resets hydraulic control module 104 to its first configuration as depicted in FIG. 3A.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A downhole hydraulic control system comprising:

a hydraulic control module positioned in a well;

first and second hydraulically controlled devices positioned in the well, the first hydraulically controlled device having a first actuator, the second hydraulically controlled device having a second actuator; and first and second hydraulic control lines extending uphole of the hydraulic control module in the well;

wherein, in a first configuration of the hydraulic control module, pressure variations in the first and second hydraulic control lines are operable to independently shift the first and second actuators in respective first directions;

wherein, in a second configuration of the hydraulic control module, pressure variations in the first and second hydraulic control lines are operable to shift the first and second actuators in respective second directions; and wherein the hydraulic control module further comprises a release assembly and a piston, wherein a high pressure signal in the second hydraulic control line is operable to unlock the release assembly and wherein a high pressure signal in the first hydraulic control line is operable shift the piston from a first position to a second position.

2. A downhole hydraulic control system comprising:

a hydraulic control module positioned in a well;

first and second hydraulically controlled devices positioned in the well, the first hydraulically controlled device having a first actuator, the second hydraulically controlled device having a second actuator; and first and second hydraulic control lines extending uphole of the hydraulic control module in the well;

wherein, in a first configuration of the hydraulic control module, pressure variations in the first and second hydraulic control lines are operable to independently shift the first and second actuators in respective first directions;

wherein, in a second configuration of the hydraulic control module, pressure variations in the first and second hydraulic control lines are operable to shift the first and second actuators in respective second directions;

wherein, the first actuator is operated in the first direction of the first actuator responsive to a high pressure signal in the first hydraulic control line ported through the hydraulic control module to a first side of the first actuator and a low pressure signal in the second hydraulic control line ported to a second side of the first actuator;

wherein, the second actuator is operated in the first direction of the second actuator responsive to a high pressure signal in the second hydraulic control line ported to a first side of the second actuator and a low pressure signal in the first hydraulic control line ported through the hydraulic control module to a second side of the second actuator; and wherein, the first and second actuators are operated in respective second directions responsive to a high pressure signal in the first hydraulic control line ported through the hydraulic control module to the second sides of the first and second actuators, a low pressure signal in the second hydraulic control line ported through the hydraulic control module to the first side the first actuator and the low pressure signal in the second hydraulic control line ported to the first side the second actuator.

3. A downhole hydraulic control method comprising:

positioning a downhole hydraulic control system in a well, the system including a hydraulic control module, first and second hydraulically controlled devices, the first hydraulically controlled device having a first actuator, the second hydraulically controlled device having a second actuator and first and second hydraulic control lines extending uphole of the hydraulic control module;

independently shifting the first and second actuators in respective first directions responsive to pressure variations in the first and second hydraulic control lines when the hydraulic control module is in a first configuration; and shifting the first and second actuators in respective second directions responsive to pressure variations in the first and second hydraulic control lines when the hydraulic control module is in a second configuration;

wherein operating the hydraulic control module from the first configuration to the second configuration further comprises unlocking a release assembly of the hydraulic control module responsive to a high pressure signal in the second hydraulic control line and shifting a piston of the hydraulic control module from a first position to a second position responsive to a high pressure signal in the first hydraulic control line.

4. A downhole hydraulic control method comprising:

positioning a downhole hydraulic control system in a well, the system including a hydraulic control module, first and second hydraulically controlled devices, the first hydraulically controlled device having a first actuator, the second hydraulically controlled device having a second actuator and first and second hydraulic control lines extending uphole of the hydraulic control module;

independently shifting the first and second actuators in respective first directions responsive to pressure variations in the first and second hydraulic control lines when the hydraulic control module is in a first configuration;

shifting the first and second actuators in respective second directions responsive to pressure variations in the first and second hydraulic control lines when the hydraulic control module is in a second configuration;

shifting the first actuator in the first direction of the first actuator responsive to a high pressure signal in the first hydraulic control line ported through the hydraulic control module to a first side of the first actuator and a low pressure signal in the second hydraulic control line ported to a second side of the first actuator;

shifting the second actuator in the first direction of the second actuator responsive to a high pressure signal in the second hydraulic control line ported to a first side of the second actuator and a low pressure signal in the first hydraulic control line ported through the hydraulic control module to a second side of the second actuator; and shifting the first and second actuators in respective second directions responsive to a high pressure signal in the first hydraulic control line ported through the hydraulic control module to the second sides of the first and second actuators, a low pressure signal in the second hydraulic control line ported through the hydraulic control module to the first side the first actuator and the low pressure signal in the second hydraulic control line ported to the first side the second actuator.

5. A hydraulic control module for use in a downhole hydraulic control system having first and second hydraulic control lines for operating first and second hydraulically controlled devices having first and second actuators, respectively, the hydraulic control module comprising:

a housing having a plurality of first ports in fluid communication with the first hydraulic control line, a plurality of second ports in fluid communication with the second hydraulic control line, a third port and a fourth port;

a release assembly disposed within the housing; and a piston slidably disposed within the housing, the piston having a first position relative to the housing in which at least one of the first ports is in fluid communication with the third port, the piston having a second position relative to the housing in which at least one of the first ports is in fluid communication with the fourth port and at least one of the second ports is in fluid communication with the third port, the piston selectively retained in the first position by the release assembly;

wherein, the release assembly is unlocked responsive to a high pressure signal in the second hydraulic control line; and wherein, while the release assembly is unlocked, the piston is shifted from the first position to the second position responsive to a high pressure signal in the first hydraulic control line.

6. The hydraulic control module as recited in claim 5 wherein the release assembly further comprises a sleeve and a collet assembly, the sleeve selectively propping the collet assembly to retain the piston in the first position.

7. The hydraulic control module as recited in claim 6 wherein the sleeve is slidably disposed within the housing between locked and unlocked positions, the sleeve is biased toward the locked position by a spring, the sleeve biases toward the unlocked position by the high pressure signal in the second hydraulic control line.

8. The hydraulic control module as recited in claim 7 wherein the sleeve includes a timing delay element operable to control the velocity at which the sleeve travels from the unlocked positioned toward the locked position to provide a time window for the high pressure signal in the first hydraulic control line to shift the piston from the first position to the second position after release of the high pressure signal in the second hydraulic control line.

9. The hydraulic control module as recited in claim 5 further comprising a spring that biases the piston from the second position toward the first position.

10. The hydraulic control module as recited in claim 5 wherein:

in the first position of the piston, a high pressure signal in the first hydraulic control line is ported through the hydraulic control module to a first side of the first actuator and a low pressure signal in the second hydraulic control line is ported to a second side of the first actuator to operate the first actuator in a first direction;

in the first position of the piston, a high pressure signal in the second hydraulic control line is ported to a first side of the second actuator and a low pressure signal in the first hydraulic control line is ported through the hydraulic control module to a second side of the second actuator to operate the second actuator in a first direction; and in the second position of the piston, a high pressure signal in the first hydraulic control line is ported through the hydraulic control module to the second sides of the first and second actuators, a low pressure signal in the second hydraulic control line is ported through the hydraulic control module to the first side the first actuator and the low pressure signal in the second hydraulic control line is ported to the first side of the second actuator to operate the first and second actuators in respective second directions.

* * * * *